United States Patent [19]

Hosemann et al.

[11] Patent Number: 4,944,813

[45] Date of Patent: Jul. 31, 1990

[54] PROCESS FOR PHOSPHATING METAL SURFACES

[75] Inventors: Kurt Hosemann, Titz; Reinhard Opitz, Dueren, both of Fed. Rep. of Germany

[73] Assignee: Gerhard Collardin GmbH, Koeln-Ehrenfeld, Fed. Rep. of Germany

[21] Appl. No.: 297,155

[22] Filed: Jan. 13, 1989

[30] Foreign Application Priority Data

Jan. 14, 1988 [DE] Fed. Rep. of Germany ..... 3800835

[51] Int. Cl.[5] ..... C23C 22/12

[52] U.S. Cl. ..... 148/260; 148/263; 148/246; 72/42

[58] Field of Search ..... 148/246, 263, 260; 72/42

[56] References Cited

U.S. PATENT DOCUMENTS

| | | | |
|---|---|---|---|
| 3,090,709 | 5/1963 | Hemricks | 148/263 |
| 3,104,177 | 9/1963 | Goldsmith | 148/263 |
| 3,161,549 | 12/1964 | Kallenbach | 148/263 |
| 4,622,078 | 11/1986 | Opitz et al. | 148/6.15 |
| 4,688,411 | 8/1987 | Hagity | 72/42 |

FOREIGN PATENT DOCUMENTS

| | | | |
|---|---|---|---|
| 0045110 | 10/1984 | European Pat. Off. . | |
| 2540685 | 3/1977 | Fed. Rep. of Germany . | |
| 1555529 | 9/1976 | United Kingdom . | |
| 2169620 | 7/1986 | United Kingdom | 148/260 |

OTHER PUBLICATIONS

Patent Abstracts of Japan, G Field, Jul. 15, 1980, vol. 4, No. 98 (C-18) (580)

*Primary Examiner*—Sam Silverberg

*Attorney, Agent, or Firm*—Ernest G. Szoke; Wayne C. Jaeschke; Norvell E. Wisdom, Jr.

[57] ABSTRACT

The present invention relates to a process for phosphating metal surfaces, and more specifically of surfaces of iron, zinc, and aluminum and the alloys thereof as a pretreatment for cold working wherein the surfaces without previous activation are contacted in a temperature range of from 30° C. to 70° C. with an aqueous solution containing (a) from 10 to 40 g/l of $Ca^{2+}$ ions, (b) from 10 to 40 g/l of $Zn^{2+}$ ions, (c) from 10 to 100 g/l of $OP_4^{3-}$ ions and, as accelerator, (d) from 10 to 100 g/l of $NO_3^-$ ions and/or (e) from 0.1 to 2.0 g/l of organic nitro compounds, said solution exhibiting a pH value in the range of from 2.0 to 3.8 and a ratio of free acid to total acid of from 1:4 to 1:100.

16 Claims, No Drawings

PROCESS FOR PHOSPHATING METAL SURFACES

FIELD OF THE INVENTION

The present invention relates to a process for phosphating metal surfaces, and more particularly to zinc-calcium phosphating surfaces of iron, zinc, aluminum, and their alloys as a pretreatment before cold working. The process is particularly adapted to phosphating steel.

STATEMENT OF RELATED ART

Processes for phosphating surfaces of iron, steel, zinc and the alloys thereof, and aluminum have long been known. See, e.g., *Ullmanns Encyklopadie der technischen Chemie*, 4th Edition, Volume 15 Page 686 et seq.). Phosphating said surfaces serves to increase the adhesion strength of subsequently applied paint or similar surface finishing materials and to improve the protection from corrosion.

The two most important general types of phosphating processes are zinc phosphating and alkali phosphating. Zinc phosphating baths generally contain zinc dihydrogen phosphate, free phosphoric acid, additional zinc salts such as the nitrate, and oxidants (also known as accelerators) as the main components. The pH value of such solutions conventionally is in the range between 2.8 and 3.4. The process proceeds in two stages, first the dissolution of metal from the surface to be coated as a result of attack on the metal by the acid in the bath and then the formation of a zinc phosphate layer on the surface to be phosphated.

In contrast, alkali phosphating processes clean and degrease the metal surface and form an anticorrosive covering layer which mainly consists of iron phosphate. The layer formation is initiated by a reaction wherein a small amount of the substrate metal is dissolved. The predominant portion of the dissolved surface material reacts with phosphate ions from the solution to form sparingly soluble phosphates which are deposited as a strongly adhering coating on the surface. In contrast to zinc phosphating, here the cation in the phosphate layer is derived from the substrate metal itself.

In anticorrosion alkali phosphating, there are two common layer types: Iron phosphate layers having a low layer weight of about 0.2 to 0.4 g/m$^2$, and iron phosphate layers having higher area weights of 0.6 to 1.2 g/m$^2$. The thin phosphate layers are particularly suitable for being coated with paint; they provide an excellent paint adhesion, good protection from interstitial rust formation, electrical insulation, and reduction in the sliding resistance and facilitate cold working.

In order to form smooth phosphate layers, it is usually advantageous to "activate" the surfaces by contact with a solution containing a suitable form of soluble titanium before contacting the surfaces with the phosphating bath. For some types of baths, however, such activation is not needed.

For cold working, phosphate layers having a layer weight of up to 40 g/m$^2$ are usually used. Metal soaps are known to be formed by the reaction of the known phosphate layers for cold working with appropriate sodium or potassium stearate soaps. Aluminum, calcium, lithium, zinc and magnesium stearates are known to be water-repellent and when used as solid lubricants in wire-drawing at higher pressures per unit area provide lower frictional values than those provided by conventional alkali soaps such as sodium stearate.

Since the melting points of these other metal stearates are lower than those of sodium stearate, and the other metal stearates when used alone are too oily, in practice supporting materials such as lime are usually incorporated in order to retain the other metal soaps in the drawing zone where lubricant is needed. Other metal soaps have the advantages over alkali soaps that they absorb hardly any moisture from the air, retain their lubricating power unchanged due to their high compression stability, and enable higher reductions in cross section to be employed, whereas the lubricating effect of alkali soaps may be greatly lowered by moisture absorption.

European Patent Specification No. 0 045 110 describes a process for the formation of phosphate coatings on iron or steel surfaces by an immersion or flow coating process using an aqueous acidic zinc phosphate solution containing $Zn^{2+}$, $PO_4^{3-}$, and $NO_3^-$ or a similarly acting accelerator that does not oxidize iron(II). In this solution the ratio by weight of $Zn:PO_4$ is greater than 0.8, the ratio of total acid to free acid is at least 5, and the iron(II) content is adjusted to from 0.05 to 1% by weight by adding a suitable amount of $ClO_3^-$ or another similarly powerful accelerator that oxidizes iron(II) to iron(III). Calcium ion is also taught as an optional ingredient in the phosphating solutions used in this reference.

It is an object of the present invention to provide an improved process for phosphating metal surfaces, and more specifically, surfaces of iron, zinc, aluminum and the alloys thereof as a pretreatment for cold working.

DESCRIPTION OF THE INVENTION

Except in the operating examples, or where otherwise specifically indicated, all numbers in this description that specify amounts of ingredients or reaction conditions are to be understood as modified by the word "about".

In brief, the present invention is a process for phosphating metal surfaces, and more particularly surfaces of iron, zinc, aluminum, and the alloys thereof as a pretreatment for cold working, wherein the surface is cleaned and/or etched in a conventional manner, except that the metal surfaces without previous activation are contacted in a temperature range of from 30° C. to 70C. with an aqueous solution containing (a) from 10 to 40 g/l of $Ca^{2+}$ ions,
(b) from 10 to 40 g/l of $Zn^{2+}$ ions,
(c) from 10 to 100 g/l of $PO_4^{3-}$ ions and, as accelerator, (d) from 10 to 100 g/l of $NO_3^-$ ions and/or
(e) from 0.1 to 2.0 g/l of organic nitro compounds, said solution exhibiting a pH value in the range of from 2.0 to 3.8 and a ratio of free acid to total acid of from 1:4 to 1:100.

Surprisingly, although the Zn:Ca ratio is different from that preferred according to the European Patent 0 045 101 and in spite of the high proportions of calcium in the phosphating solution, the phosphate layer formed has a structure that was not to be expected according to prior art.

According to a preferred embodiment of the present invention, the phosphating solution with which the surfaces to be coated are brought into contact may contain $Zn^{2+}$ - and $Ca^{2+}$ ions in the ratio by weight of from 1:0.5 to 1:1.5, and preferably in a ratio of 1:1.

Advantageously, preferred embodiments of the phosphating solutions for use in this invention also contain cations of transition metals in addition to the above-mentioned $Ca^{2+}$ and $Zn^{2+}$ cations. Particularly preferred are $Ni^{2+}$ ions When the phosphating solutions contain $Ni^{2+}$ ions, an amount of from 0.01 to 10 g/l of $Ni^{2+}$ ions is preferred.

In addition to the anions mentioned such as $PO_4^{3-}$ and $NO_3^-$ ions, phosphating solutions according to the invention may also contain additional anions. According to one preferred embodiment, these anions include simple and/or complex fluorides. These may be used in the phosphating solutions, more preferably, in amounts of from 0.01 to 10 g/l.

While the process according to the invention is regularly carried out in the range of from 30° C. to 70° C., one preferred embodiment of the present invention includes adjusting the temperature range to from 50° C. to 70° C. and contacting the metal surfaces with the phosphating solutions.

Phosphating solutions for use according to the invention may contain from 0.1 to 2.0 g/l of organic nitro compounds in the place of 10 to 100 g/l $NO_3^-$ - ions. Organic nitro compounds within the scope of the present invention are m-nitrobenzene sulfonates and/or nitroguanidine. The organic nitro compounds may also be present in an amount of from 0.1 to 2.0 g/l of organic nitro compounds in addition to 10 to 100 g/l $NO_3^-$ - ions in the phosphating solutions. According to one preferred embodiment of the present invention, the process produces zinc-calcium phosphate (scholzite) layers having an areal mass of from 3 to 9 g/m$^2$.

The zinc-calcium phosphate layers may be produced on the metal surfaces by immersion, spraying and flow coating as well as by combined procedures. Prior to the application of the phosphating process according to the invention the surfaces to be phosphated are degreased according to processes known in the art. Residues of oil, grease and lubricant or of grinding dust left over from preceding manufacturing processes may be removed by organic solvents or water based cleansing agents.

Chlorinated hydrocarbons are the most frequently used organic solvents, because they effectively dissolve oils and greases and are not inflammable. However, solid materials and inorganic contaminants on the surface may be insufficiently removed by chlorinated hydrocarbons. Water-based cleaning agents have a very high cleaning efficiency. They contain surface-active substances emulsifying oil and grease in water and inorganic components such as carbonates, silicates, borates and phosphates which exhibit alkaline reaction and saponify natural fats.

A further possibility for pre-cleaning prior to phosphating consists of subjecting the metal surfaces to be cleaned to ultrasonic or mechanical cleaning procedures.

A major advantage of the present invention is that the zinc-calcium phosphate layers can readily be applied to wire in layer weights of from 3 to 9 g/m$^2$.

The zinc-calcium phosphate layers formed in the process of this invention for the most part contain the mineral scholzite. Upon reaction of the zinc-calcium phosphate layers with the sodium stearate soaps used in the art, there is formed, in addition to zinc stearate and calcium stearate, a mixed zinc-calcium stearate.

Zinc-calcium stearate has the advantage in technical wire drawing that the use-life of the drawing die is much increased. Drawing tests in a technical test unit further gave the result that the wire surfaces show a substantially brighter and more uniform optical appearance, especially after a subsequent polishing draw, than is attainable by conventional phosphating procedures run with more highly oxidizing accelerators that readily oxidize iron (ii) to iron (III) in the bath.

A further advantage of the invention is that the new zinc-calcium phosphating process for cold working may be advantageously performed in a temperature range of from 50° C. to 70° C. Sludging resistance of the solutions is particularly favorable in this process, since even after a bath load of 1.5 m$^2$ of steel surface per 1 liter of bath solution only a minimum amount of bath sludge, on the order of a few milliliters, is formed. A still further advantage of the present invention is that the zinc-calcium stearate mixed soaps that can be formed by reacting the phosphate layers produced by this invention with sodium or potassium stearate enable the drawing die to have a longer use-life.

The practice of the invention is illustrated by the following operating examples, which are not intended to limit the invention in any way.

EXAMPLE 1

A phosphating solution was prepared which contained 10.3 g $l^{-1}$ of $Ca^{2+}$ ions, 14.0 g $l^{-1}$ of $Zn^{2+}$ ions, 27.8 g $l^{-1}$ of $PO_4^{3-}$ ions, and 46.5 g $l^{-1}$ of $NO_3^-$ ions. It also had the following characteristics: a pH value of about 2.6, and an acid ratio (free acid to total acid) of about 1:21.

Steel wires which previously had been cleaned with an alkaline cleansing solution by an immersion treatment at 80° C. for 10 minutes and rinsed with water were treated with the above phosphating solution by immersion at 50° C. for 7 min. Then the wires were rinsed with water, and a reactive soap was applied to the wire surface. Then the wires were drawn through drawing dies. The result was a very bright and shiny surface, which could not be attained by using phosphating solutions other than those according to the invention.

EXAMPLE 2

A solution was prepared which contained 18.0 g/l of $Ca^{2+}$ ions, 12.0 g/l of $Zn^{2+}$ ions, 2.8 g/l of $Ni^{2+}$ ions, 87.2 g/l of $PO_4^{3-}$ ions, and 27.5 g/l of $NO_3^-$ ions. The solution pH value was 2.5, and the ratio of free acid to total acid was 1:17.6.

Steel wire which previously had been cleaned in an alkaline immersion bath at 80° C. for 10 minutes and then cold rinsed was treated with the above phosphating solution by immersion at 55° C. for 10 min. Then the wires were rinsed with water, and a reactive drawing soap was applied to the wire in an immersion bath at 80° C.

The wire thus coated could be readily drawn through several drawing dies in series, to be reduced to a predetermined dimension. In this manner, a bright and shiny surface was formed on the wire.

What is claimed is:

1. In a process comprising cleaning and phosphating metal surfaces, the improvement wherein the surfaces without previous activation are contacted in a temperature range of from 30° C. to 70° C. with an aqueous solution consisting essentially of:

(a) from about 10 to about 40 g/l of $Ca^{2+}$ ions, (b) from about 10 to about 40 g/l of $Zn^{2+}$ ions, (c) from about 10 to about 100 g/l of $PO_4^{3-}$ ions, (d) an accelerator selected from the group consisting of
  (i) about 10 to about 100 g/l of nitrate ions and
  (ii) about 0.1 to about 2.0 g/l of organic nitro compounds,
(e) up to about 10 g/l of $Ni^{2+}$ ions, and
(f) up to abut 10 g/l of simple, complex, or mixed simple and complex fluoride ions,
  said solution having a pH value in the range from about 2.0 to about 3.8, a ratio of free acid to total acid from about 1:4 to 1:100, and a ratio by weight of $Zn^{+2}$ ions to $Ca^{+2}$ ions of about 1:0.5 to about 1:1.5; said process producing on the metal surfaces a phosphate layer containing scholzite in an areal density between about 3 and about 9 g/m$^2$.

2. A process according to claim 1, wherein the phosphating solution comprises $Ni^{2+}$ ions in an amount of at least about 0.01 g/l.

3. A process according to claim 2, wherein the phosphating solution comprises simple, complex, or mixed simple and complex fluoride ions in an amount of at least about 0.01 g/l.

4. A process according to claim 3, characterized in that the metal surfaces are phosphated at temperatures between about 50° C. and about 70° C.

5. A process according to claim 2, characterized in that the metal surfaces are phosphated at temperatures between about 50° C. and about 70° C.

6. A process according to claim 1, characterized in that the metal surfaces are phosphated at temperatures between about 50° C. and about 70° C.

7. A process according to claim 6, wherein the metal phosphated is an alloy of iron, zinc, or aluminum.

8. A process according to claim 5, wherein the metal phosphated is an alloy of iron, zinc, or aluminum.

9. A process according to claim 4, wherein the metal phosphated is an alloy of iron, zinc, or aluminum.

10. A process according to claim 3, wherein the metal phosphated is an alloy of iron, zinc or aluminum.

11. A process according to claim 2, wherein the metal phosphated is an alloy of iron, zinc or aluminum.

12. A process according to claim 1, wherein the metal phosphated is an alloy of iron, zinc, or aluminum.

13. A process according to claim 12, additionally comprising cold working the phosphated metal surfaces after reacting these surfaces with an alkali stearate to produce a mixed calcium-zinc stearate on the surfaces.

14. A process according to claim 6, additionally comprising cold working the phosphated metal surfaces after reacting these surfaces with an alkali stearate to produce a mixed calcium-zinc stearate on the surfaces.

15. A process according to claim 3, additionally comprising cold working the phosphated metal surfaces after reacting these surfaces with an alkali stearate to produce a mixed calcium-zinc stearate on the surfaces.

16. A process according to claim 1, additionally comprising cold working the phosphated metal surfaces after reacting these surfaces with an alkali stearate to produce a mixed calcium-zinc stearate on the surfaces.

* * * * *